US007052347B2

(12) United States Patent
Goldmeier

(10) Patent No.: US 7,052,347 B2
(45) Date of Patent: May 30, 2006

(54) ELONGATED FLOTATION DEVICE WITH SPRAY NOZZLE

(75) Inventor: Steven Goldmeier, Plainview, NY (US)

(73) Assignee: Rand International, Inc., Farmington, NY (US)

( * ) Notice: Subject to any disclaimer, the term of this patent is extended or adjusted under 35 U.S.C. 154(b) by 0 days.

(21) Appl. No.: 11/085,535

(22) Filed: Mar. 22, 2005

(65) Prior Publication Data

US 2005/0215140 A1 Sep. 29, 2005

Related U.S. Application Data

(60) Provisional application No. 60/555,329, filed on Mar. 23, 2004.

(51) Int. Cl.
*B63C 9/08* (2006.01)

(52) U.S. Cl. ..... 441/129; 446/153; 472/129

(58) Field of Classification Search ..... 441/88, 441/130, 131, 132, 136, 129; 446/153, 160; 472/128, 129

See application file for complete search history.

(56) References Cited

U.S. PATENT DOCUMENTS 2,801,850 A 8/1957 Yount
4,223,894 A * 9/1980 Fabricant ..... 446/160
4,703,892 A 11/1987 Nadel
4,932,912 A 6/1990 Combs
5,009,413 A * 4/1991 Allen ..... 472/128
5,231,951 A 8/1993 Tagar et al.
D390,425 S 2/1998 Henry et al.
5,928,053 A 7/1999 Henderson
5,971,823 A 10/1999 Sanso
6,027,393 A 2/2000 O'Rourke
6,257,944 B1 7/2001 Herrod
6,482,058 B1 11/2002 Sanso et al.
6,551,193 B1 * 4/2003 Edwards ..... 472/128
6,790,112 B1 9/2004 Kirk
2004/0259440 A1 12/2004 Kirk

* cited by examiner

*Primary Examiner*—Lars A. Olson
(74) *Attorney, Agent, or Firm*—Edell, Shapiro & Finnan LLC

(57) ABSTRACT

A flotation device includes an elongated and flexible member with a channel extending between longitudinal ends of the flexible member, where the flexible member is configured to support an individual within water during a recreational activity, and a nozzle member securable to the flexible member. The nozzle member includes a flexible bulb member with at least one opening and a shaft suitably dimensioned to fit within the channel of the flexible member to secure the nozzle member to the flexible member. The bulb member can be squeezed to establish a pressure differential between a location within the bulb member and a location near the at least one opening.

9 Claims, 5 Drawing Sheets

ELONGATED FLOTATION DEVICE WITH SPRAY NOZZLE

CROSS REFERENCE TO RELATED APPLICATION

This application claims priority from: U.S. Provisional Patent Application Ser. No. 60/555,329 entitled "Noodle Flotation Device With Spray Nozzle," and filed Mar. 23, 2004. The disclosure of this provisional patent application is incorporated herein by reference in its entirety.

BACKGROUND OF THE INVENTION

1. Field of the Invention

The present invention relates to a recreational flotation device for use in pools and other bodies of water.

2. Description of the Related Art

Flotation devices, such as inflatable or floating rafts, are well known for use in recreational water activities. One particular device that has recently become popular for use in pools and at beaches is an elongated flotation device that is shaped in the form of a noodle and is made of a flexible material (e.g., foam) that has a sufficient buoyancy to support a user at the water surface during use.

It is desirable to provide a floatation device that has a simple design and provides additional recreational and aesthetic features, such as a water squirting feature.

SUMMARY OF THE INVENTION

In accordance with the present invention, a flotation device includes an elongated and flexible member with a channel extending between longitudinal ends of the flexible member, where the flexible member is configured to support an individual within water during a recreational activity, and a nozzle member securable to the flexible member. The nozzle member includes a bulb member with at least one opening and a shaft suitably dimensioned to fit within the channel of the flexible member to secure the nozzle member to the flexible member. The bulb member can be squeezed to establish a pressure differential between a location within the bulb member and a location near the at least one opening.

The above and still further objects, features and advantages of the present invention will become apparent upon consideration of the following descriptions and descriptive figures of specific embodiments thereof, wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1A:
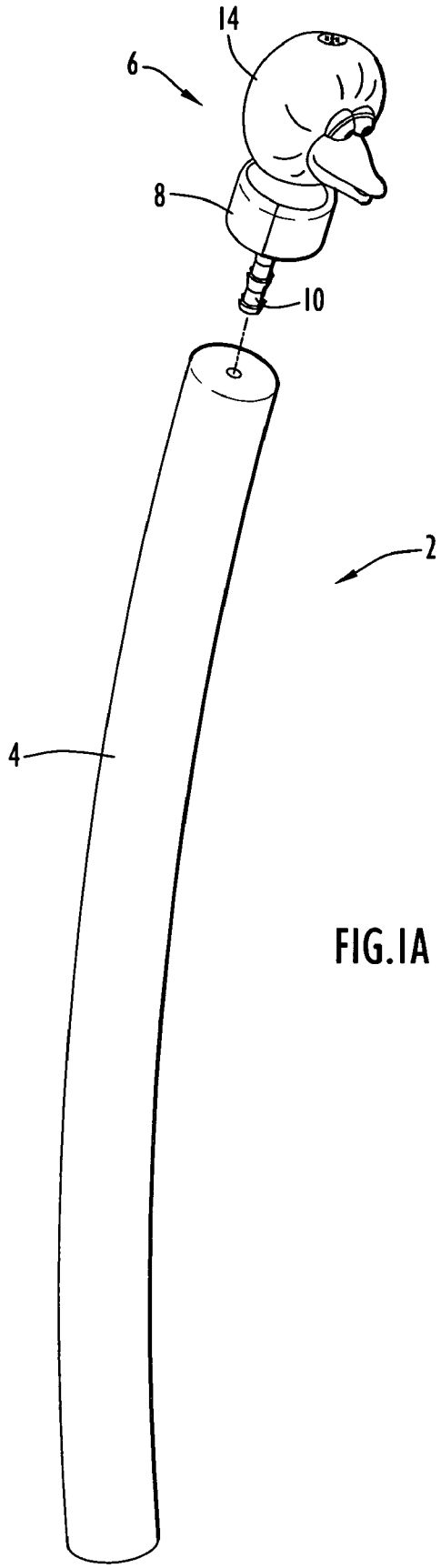
FIG. 1A depicts an exploded view in perspective of an embodiment of an elongated flotation device with spray nozzle in accordance with the present invention.

In an exemplary embodiment of the present invention depicted in FIGS. 1A, 1B, 2 and 3, an elongated flotation device 2 includes an elongated, generally cylindrical noodle section 4 that is constructed of a soft foam material that has a sufficient buoyancy to serve as a general floatation device by a user during recreational activity. Alternatively, the noodle section may be constructed of any other suitable flexible material that has a suitable buoyancy and may also have any other selected cross-sectional geometric configuration (e.g., square, multifaceted, etc.). The noodle section 4 is hollow and includes a narrow channel that extends between the ends of the noodle section.

A nozzle member 6 is secured at one end of the noodle section 4. In particular, the nozzle member 6 includes a hollow cuff 8 that is suitably dimensioned to fit snugly around the end of the noodle section 4 when the nozzle member is secured to the noodle section. The cuff provides stability to the nozzle member with respect to the noodle section during operation of the flotation device. A hollow securing shaft 10 extends from the cuff 8 (see FIG. 2) and is suitably dimensioned to fit within the channel extending through the noodle section 4. The securing shaft 10 includes a series of radially extending or flared ridges 12 disposed along the longitudinal dimension of the shaft. Each flared ridge 12 extends longitudinally with increasing radial dimension along the shaft 10 in a direction toward the cuff 8 and terminates at a ledge 13. The greatest radial dimensions of the ridges are slightly larger than the transverse dimension of the channel within the noodle section, such that the ridges 12 serve to lock the shaft 10 within the noodle section channel to prevent inadvertent removal of the nozzle member 6 from the noodle section 4 after the shaft is inserted within the channel. The nozzle member can be removably secured to the noodle section, via the shaft, or, alternatively, permanently secured (e.g., via adhesive applied between the shaft and the internal channel of the noodle section).

The shaft 10 extends through an opening in the sealed end of the cuff 8 and engages with a hollow bulb member 14 as described below. A channel extending through the hollow shaft 10 facilitates fluid communication between the bulb member 14 and the noodle section 4.

The bulb member 14 is disposed adjacent the sealed end of the cuff 8 and includes an opening that is suitably dimensioned to receive and retain a terminal end of the shaft 10 that extends through the cuff opening. The bulb member 14 and shaft 10 engage each other in a fluid tight relationship (e.g., via a suitable seal disposed at the opening within the bulb member 14), and the shaft 10 and cuff opening also engage each other in a fluid tight relationship (e.g., via a gasket disposed around the cuff opening and the shaft) so as to prevent water from leaking out of the cuff opening and/or the bulb member as if flows between these two elements.

The bulb member 14 is made of a resilient and flexible plastic material that can be easily squeezed by a user to compress the bulb member. Upon release of the bulb member 14 by the user and/or an increase in pressure within the bulb member, the bulb member resiliently expands back to its original configuration. Optionally, the bulb member 14 has an aesthetically pleasing design, including suitable indicia and/or geometric features that resemble a caricature, person, animal, etc. For example, the bulb member 14 of FIGS. 1A, 1B, 2 and 3 resembles the head of a bird.

Figure 1B:
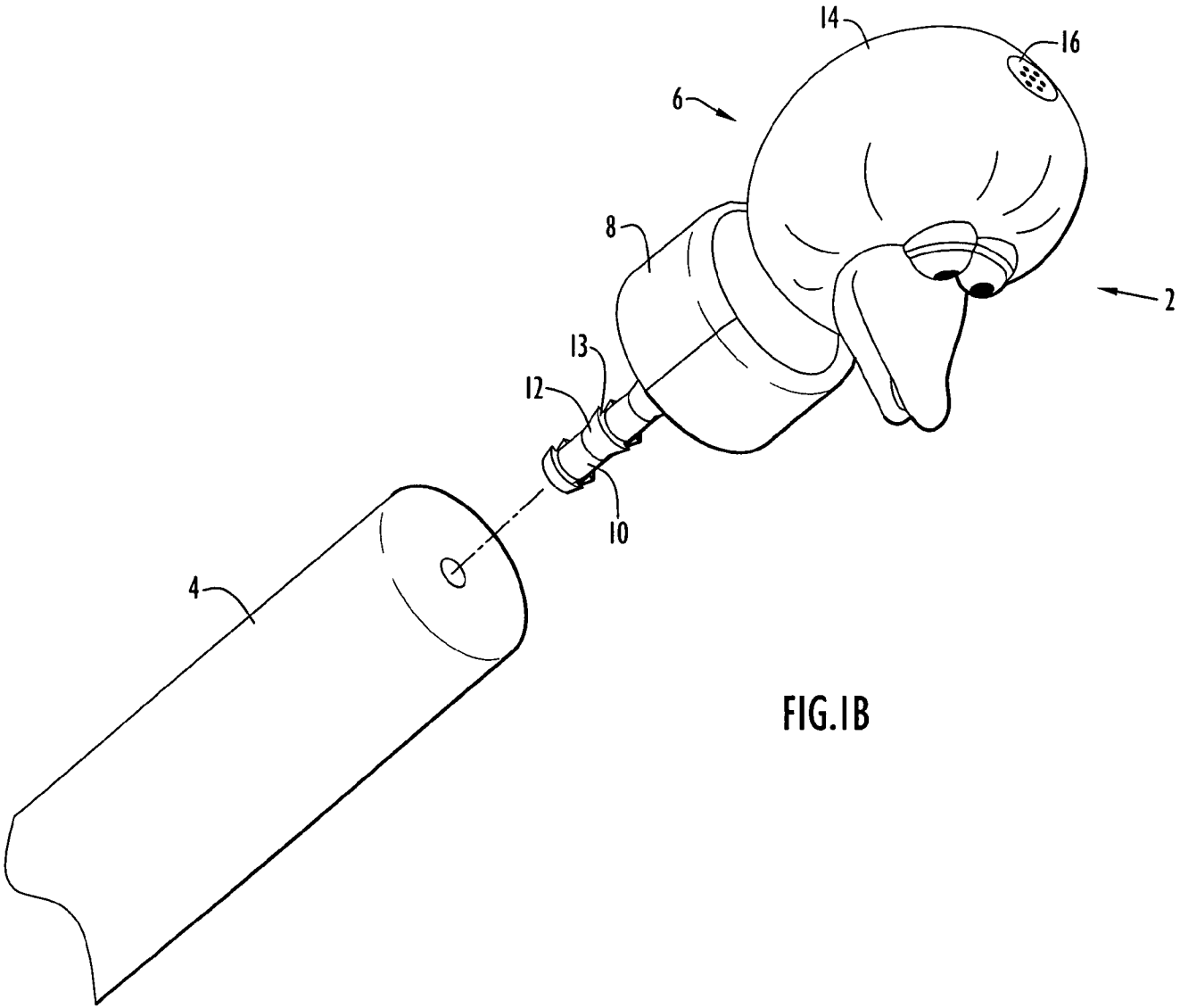
FIG. 1B depicts an exploded view in perspective of an end portion of the elongated flotation device with spray nozzle of FIG. 1A.
Figure 2:
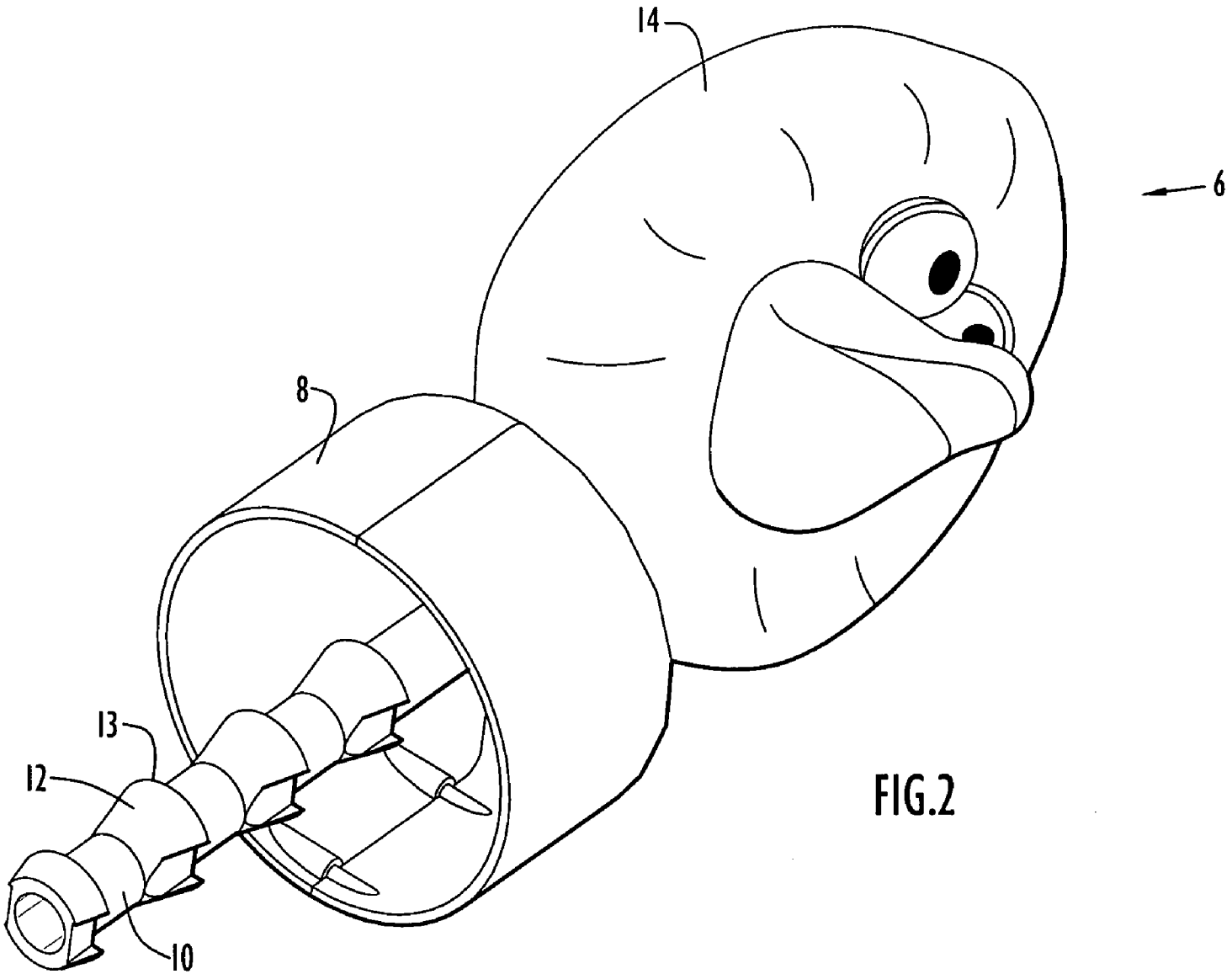
FIG. 2 depicts a view in perspective of the nozzle member of the flotation device of FIG. 1A showing the interior of the cuff of the nozzle member.
Figure 3:
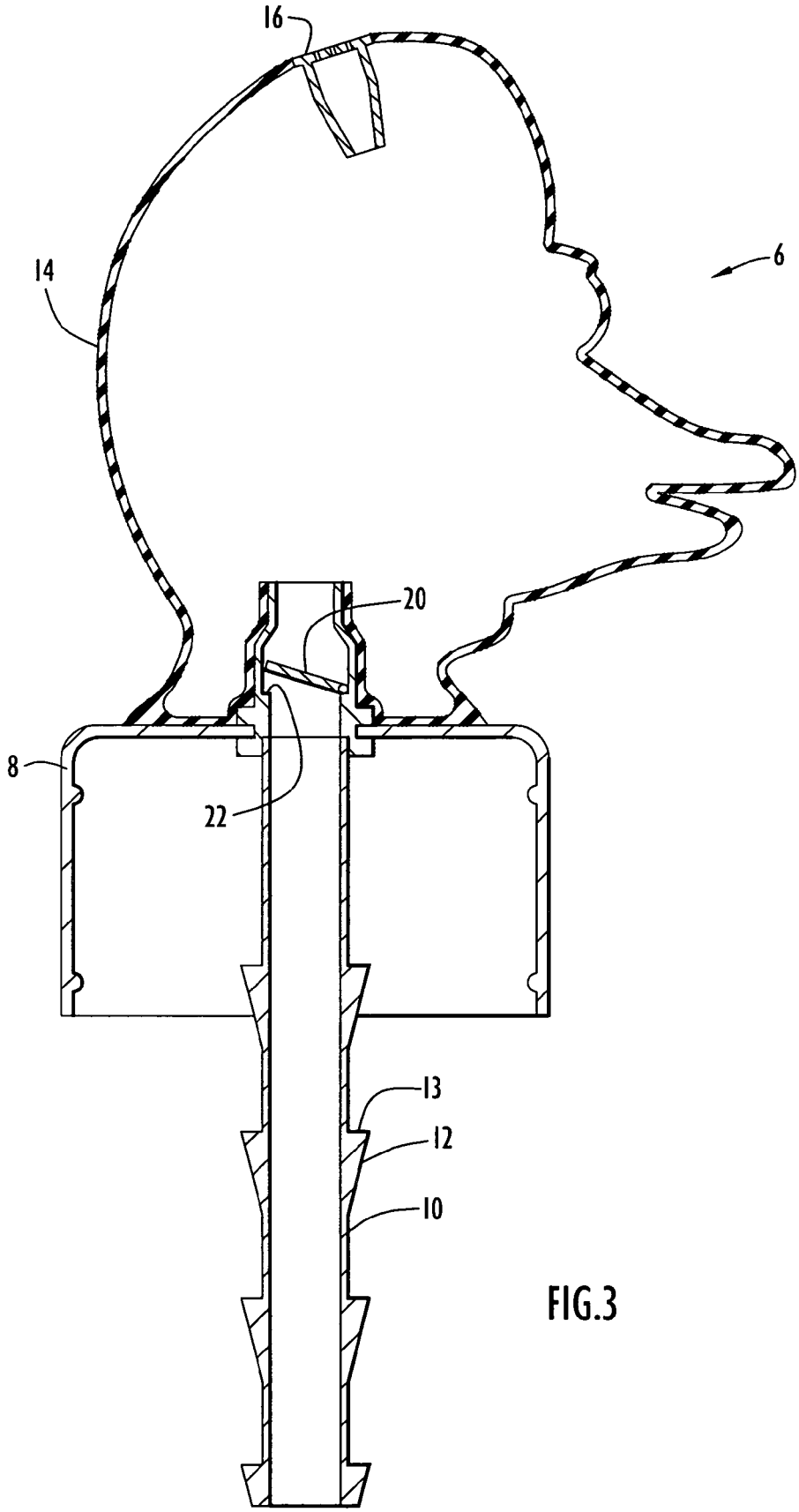
FIG. 3 depicts a side view in cross-section of the nozzle member showing the valve mechanism for the flotation device of FIG. 1A.

A spray nozzle 16 is disposed at a suitable location on the bulb member 14 (e.g., at the top of the bird head design of the bulb member as depicted in FIG. 1B). The spray nozzle 16 includes a series of apertures that facilitate spray of water through the nozzle 16 during recreational use of the device as described below. Optionally, a one-way valve is provided at a suitable location within the bulb member 14 (e.g., adjacent the spray nozzle 16 or adjacent a location where the shaft 10 engages the bulb member) to permit water to enter the bulb member 14 via the shaft 10 and/or the spray nozzle 16 but to minimize or prevent water from flowing from the bulb member 14 into the shaft 10. In an exemplary embodiment as depicted in FIG. 3, the one-way valve includes a flap 20 that is hingedly secured to an internal wall portion within the shaft 10. A ledge 22 is further provided within the shaft 10 and aligned with the flap 20 to prevent movement of the flap beyond the ledge during operation of the spray nozzle 16. In addition, the engagement of the flap 20 with the ledge 22 minimizes or substantially prevents water within the bulb member 14 from exiting through the shaft 10 when the bulb member is squeezed.

During use, the spray nozzle 16 can be selectively manipulated by the user to direct a spray of water from the bulb member 14 in a particular direction. This water spray action can be achieved in different ways. In one use, the opposing or free end of the noodle section 4 (i.e., the end that is not engaged with the nozzle member 6) is submerged in water, and the bulb member 14 is squeezed by the user to generate a pressure differential within the device that draws water through the noodle section 4 and into the shaft 10 and bulb member 14. When a one-way valve is implemented, such as the flap 20 depicted in FIG. 3, the flap is moved away from the ledge 22 when the bulb member 14 is first squeezed, which establishes a pressure differential between the interior of the bulb member and the interior of the shaft that facilitates the suction of water through the shaft 10 and into the bulb member. After the bulb member has been filed with water, further squeezing and/or release of the bulb member 14 by the user results in spraying of water through the apertures of the spray nozzle 16. The bulb member can then be squeezed again to facilitate filling of the bulb member with more water. The flap 20 of the one-way valve is forced against the ledge 22 to minimize or substantially prevent the flow of water into the shaft 10, such that the primary exit for water from the bulb member 14 is through the spray nozzle 16.

In another use, the bulb member 14 is submerged in water and squeezed to generate the pressure differential, resulting in water being drawn into the bulb member 14 via the spray nozzle 16. The bulb member 14 is then removed from the water and squeezed again to force the water back through the spray nozzle 16.

When using the device in a pool or other large body of water, the user can be supported on a mid portion of the noodle section 4 so as to float in the water with the noodle section 4. The user can also manipulate the bulb member 14 in any of the manners described above to spray water from the spray nozzle 16 in one or more selected directions.

Figure 4:
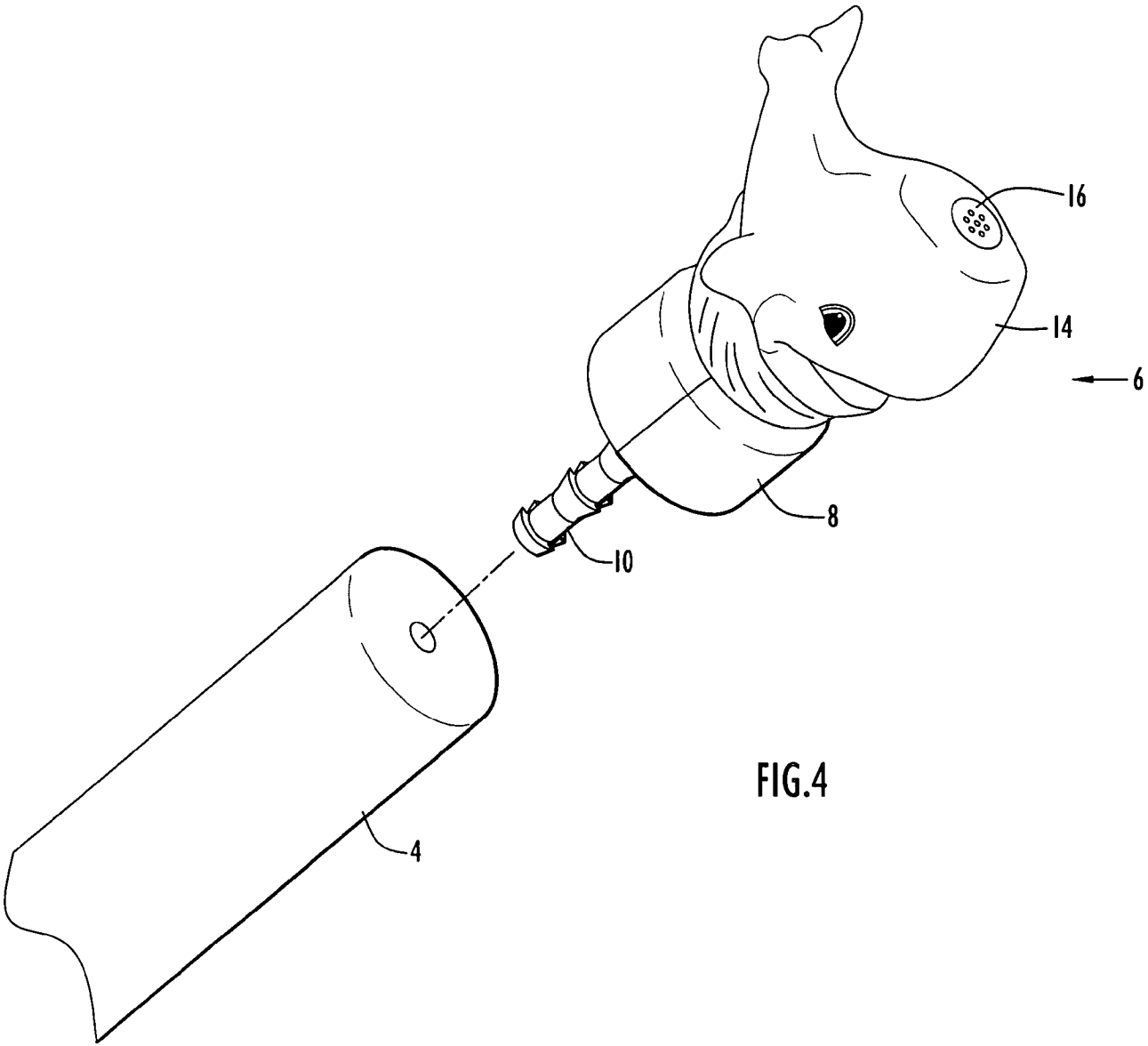
FIG. 4 depicts an exploded view in perspective of an end portion of another embodiment of an elongated flotation device with spray nozzle in accordance with the present invention.

As noted above, the bulb member can include any selected geometrical configuration. An exemplary alternative embodiment is depicted in FIG. 4, where the bulb member has the general shape of a fish or a whale.

In addition, the bulb member and shaft can be configured such that the bulb member is sealed with respect to and thus not in fluid communication with the shaft. In this embodiment, the bulb member the spray nozzle for the bulb member serves as both the inlet and outlet for water. The bulb member is filled by submerging the bulb member in water and squeezing the bulb member such that, when the bulb member expands to its original configuration, water flows into the bulb member via the spray nozzle. Water is then removed from the bulb member via the spray nozzle by squeezing the bulb member (e.g., when the bulb member is no longer submerged within the water).

The spray nozzle can include any design and any suitable number of openings (e.g., one or more). In addition, the spray nozzle can be located at any suitable location on the bulb member. For example, while the embodiments depicted above in FIGS. 1–4 include a spray nozzle that includes a plurality of openings disposed near a distal portion of the bulb member, the spray nozzle can alternatively be realized as a single opening disposed at another location of the bulb member (e.g., at a location that corresponds with the mouth of the caricature formed by the bulb member).

Having described preferred embodiments of an elongated flotation device with a spray nozzle, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A flotation device comprising:

an elongated and flexible member including a channel extending between longitudinal ends of the flexible member, the flexible member being configured to support an individual in a body of water at the water surface; and a nozzle member securable to the flexible member, the nozzle member comprising a bulb member including at least one opening and a shaft suitably dimensioned to fit within the channel of the flexible member to secure the nozzle member to the flexible member, wherein the bulb member is squeezable to establish a pressure differential between a location within the bulb member and a location near the at least one opening, and the nozzle member further comprises a cuff attached with the bulb member and configured to fit around an outer peripheral end of the flexible member when the nozzle member is secured to the flexible member.

2. The flotation device of claim 1, wherein the at least one opening of the bulb member comprises a plurality of apertures to facilitate a flow of a spray of liquid from the bulb member through the apertures.

3. The flotation device of claim 1, wherein the shaft includes a plurality of flared ridges disposed longitudinally along the shaft, each flared ridge increasing in radial dimension in a direction in which the flared ridge extends toward the bulb member.

4. The flotation device of claim 1, further comprising a one-way valve secured within the shaft of the nozzle member, wherein the at least one opening of the nozzle member comprises an opening disposed on an exterior peripheral surface of the bulb member and an opening disposed proximate the one-way valve to facilitate a flow of fluid from the shaft into the bulb member when the bulb member is squeezed.

5. A flotation device comprising:

an elongated and flexible member including a channel extending between longitudinal ends of the flexible member, the flexible member being configured to support an individual in a body of water at the water surface; and a nozzle member securable to the flexible member, the nozzle member comprising a bulb member including at least one opening and a shaft suitably dimensioned to fit within the channel of the flexible member to secure the nozzle member to the flexible member;

wherein the shaft includes a plurality of flared ridges disposed longitudinally along the shaft, each flared ridge increasing in radial dimension in a direction in which the flared ridge extends toward the bulb member, and the bulb member is squeezable to establish a pressure differential between a location within the bulb member and a location near the at least one opening.

6. A method of using a flotation device comprising:

providing an elongated and flexible member including a channel extending between longitudinal ends of the flexible member, the flexible member being configured to support an individual in a body of water at the water surface;

securing a nozzle member to the flexible member, the nozzle member comprising a bulb member including at least one opening and a shaft suitably dimensioned to fit within the channel of the flexible member to secure the nozzle member to the flexible member, and the nozzle member further comprising a cuff attached with the bulb member and including a cuff portion that fits around an outer peripheral end of the flexible member; and squeezing the bulb member to establish a pressure differential between a location within the bulb member and a location near the at least one opening so as to facilitate at least one of a flow of liquid into the bulb member and a flow of liquid out of the at least one opening.

7. The method of claim 6, wherein the at least one opening of the bulb member comprises a plurality of apertures to facilitate a flow of a spray of liquid from the bulb member through the apertures.

8. The method of claim 6, wherein the shaft includes a plurality of flared ridges disposed longitudinally along the shaft, each flared ridge increasing in radial dimension in a direction in which the flared ridge extends toward the bulb member such that each ridge engages and resists removal of the shaft from the channel when the nozzle member is secured to the flexible member.

9. The method of claim 6, wherein a one-way valve is secured within the shaft of the nozzle member, the at least one opening of the nozzle member includes an outlet disposed on an exterior peripheral surface of the bulb member and an inlet disposed proximate the one-way valve, and the squeezing of the bulb member facilitates an opening of the one-way valve and a flow of fluid from the shaft into the bulb member when the pressure differential established is such that the pressure within the bulb member is less than the pressure within the shaft.

* * * * *

UNITED STATES PATENT AND TRADEMARK OFFICE

CERTIFICATE OF CORRECTION

PATENT NO. : 7,052,347 B2
APPLICATION NO. : 11/085535
DATED : May 30, 2006
INVENTOR(S) : Goldmeier et al.

It is certified that error appears in the above-identified patent and that said Letters Patent is hereby corrected as shown below:

On the Title Page, should read
Item (75) Inventor:

Steven Goldmeier, Plainview, NY (US)
Peter Pergament, Melville, NY (US)

Signed and Sealed this

Sixth Day of May, 2008

JON W. DUDAS
*Director of the United States Patent and Trademark Office*